United States Patent [19]

Dargis

[11] Patent Number: 4,575,140

[45] Date of Patent: Mar. 11, 1986

[54] DOOR LOCK METHOD AND APPARATUS

[76] Inventor: Kenneth Dargis, 6811 Clee La., Spring, Tex. 77379

[21] Appl. No.: 470,004

[22] Filed: Feb. 28, 1983

[51] Int. Cl.[4] ..... E05C 19/18

[52] U.S. Cl. ..... 292/288; 292/289; 292/296

[58] Field of Search ..... 292/288, 258, 278, 264, 292/292, 295–298, 289; 70/14, 94

[56] References Cited

U.S. PATENT DOCUMENTS

| | | | |
|---|---|---|---|
| 366,843 | 7/1887 | Jones | 292/288 |
| 827,624 | 7/1906 | Foster | 292/288 |
| 2,151,587 | 3/1939 | Cassileth | 292/288 |
| 2,196,047 | 4/1940 | Willis | 292/288 |
| 3,313,566 | 4/1967 | Sipes | 292/292 |
| 3,316,005 | 4/1967 | Oesler | 292/296 |
| 3,421,787 | 1/1969 | Hoffman et al. | 292/289 |
| 4,004,833 | 1/1977 | Hull | 292/288 |
| 4,281,865 | 8/1981 | Nicholson | 292/258 |
| 4,334,705 | 6/1982 | Rumph | 292/288 |
| 4,386,797 | 6/1983 | Duran, Sr. | 292/292 |

FOREIGN PATENT DOCUMENTS

| | | | |
|---|---|---|---|
| 554831 | 7/1932 | Fed. Rep. of Germany | 292/264 |
| 2377509 | 9/1978 | France | 292/264 |
| 488760 | 1/1954 | Italy | 292/288 |
| 116105 | 8/1926 | Switzerland | 292/288 |
| 21844 | of 1913 | United Kingdom | 292/264 |

*Primary Examiner*—Robert L. Wolfe
*Assistant Examiner*—Lloyd A. Gall
*Attorney, Agent, or Firm*—Carwell & Helmreich

[57] ABSTRACT

A door lock mechanism is provided for positioning on the inside of the door and preventing the opening of the door. The mechanism comprises a main plate which slips over the doorknob handle, and a modified strike plate having an aperture structurally arranged for receiving a portion of the main plate. A simplified method is provided for easily and effectively securing a door, since the modified strike plate may be permanently secured to the doorjamb while the main plate may be quickly and easily positioned for locking the door. The method and apparatus of the present invention is well adapted for both commercial and residential use, since its components do not materially detract from the aesthetic qualities of the door.

20 Claims, 7 Drawing Figures

DOOR LOCK METHOD AND APPARATUS

FIELD OF THE INVENTION

The present invention pertains to methods and apparatus for locking a swinging door and, more particularly, to methods and apparatus which may be utilized to efficiently secure the door in the doorway without regard to the effectiveness of the conventional door lock.

BACKGROUND OF THE INVENTION

Various types of safety latches, locks, door restraint mechanisms and fastening devices have been devised for preventing the opening of the door and the unauthorized intrusion of persons. Many such devices, such as deadbolt locks, can be picked, wrenched, or pried from the outside by intruders, and thus do not offer the individual the desired security. Other restraining devices, such as chain locking devices, have a low yield strength (partially because the door can be opened several inches), or allow the restraining device to be cut or otherwise deactivated by the intruder. Other devices which do not suffer from the above disadvantages are typically complicated and thus expensive, require a special tool to install the device, and/or are very unsightly when both activated or deactivated, so that such devices have not been widely accepted on either a commercial or residential basis.

U.S. Pat. No. 3,513,566 to Sipes and U.S. Pat. No. 3,809,418 to Canfield disclose chain-type door fastening devices. Sipes discloses a chain for engaging the doorknob and a pair of arms for engagement with a strike plate. Canfield discloses a similar chain used in conjunction with a strike plate having a portion faced interiorly of the door. Such devices depend on the effectiveness of the chain, and are both unsightly and do not generally offer the individual the desired high degree of protection against intruders.

U.S. Pat. No. 4,155,578 to Roland discloses a safety latch utilizing a strap and a wedge member designed to prevent opening of the door when the device is in place. U.S. Pat. No. 4,254,976 discloses a door restraining mechanism utilizing a spring to exert force between a door handle shoe and a pressure face positioned against the doorjamb. These devices, at least to some extent, utilize the frictional force of engaging members. Such devices likewise have not been widely accepted, possibly because they also do not actually afford the desired high degree of security, or possibly because they are not perceived as being likely to prevent the opening of the door by a determined intruder.

Various effective hinge-type latches have been designed, which employ a pin for joining both sides of the latch. Such a simplistic latch is shown in conjunction with a window in U.S. Pat. No. 1,659,822 to Innes. Such a hinge-type latch could also be used in conjunction with a swinging door, as shown for example in FIG. 1 of U.S. Pat. No. 4,015,868 to Buttler. Finally, U.S. Pat. No. 2,396,982 to Bousquet discloses a latching device for a swinging door which comprises a plurality of plates for positioning between the door and the doorknob, a pin, a plate adjacent the pin, and another plate having a portion designed for insertion in the bolt keeper of the door frame when the lock is applied to the door. The latter device is both complicated in operation and very unsightly, while the former devices clearly marr the door when installed and also detract from the aesthetic appearance of the door.

SUMMARY OF THE INVENTION

The need therefore exists for an improved door locking device which is highly efficient yet simplistic. In addition, the device is preferably adapted so that both when being utilized and when not being utilized, the device does not detract from the general appearance of the door and need not marr or otherwise damage the door to be installed. Furthermore, the device should be simplistic both in construction and operation, so that it is ideally suited for residential use.

The present invention comprises a main plate for fitting engagement over the doorknob and a modified strike plate which may replace the conventional strike plate. According to the method of the present invention, the door may be easily and effectively locked by lowering the main plate over the doorknob with a pin portion secured to the main plate fitting into an aperture provided in a portion of the strike plate.

It is a feature of the present invention to provide a door locking apparatus which can withstand high forces to prevent unauthorized intrusion.

It is also a feature of the present invention to provide methods and apparatus for securing the door, wherein the mechanism cannot be disengaged or deactivated from the outside by an intruder.

It is a further feature of the invention to provide a door locking device which can be easily and quickly installed by the consumer with conventional tools.

It is a further feature of the present invention to provide a door locking apparatus which can be fully installed without altering or marring the door, and which does not detract from the appearance of the door when the device is in place.

It is another feature of the invention to provide a door locking apparatus which can be easily removed without damaging or defacing the door.

It is a further feature of the present invention to provide a method for easily and effectively locking or securing the door without relying upon the conventional door lock.

It is also a feature of the present invention to provide a door locking device which need not be adjusted or maintained, and one which will maintain a high level of effectiveness over time.

These and other features and advantages of the present invention will become apparent from the foregoing description, wherein reference is made to the Figures in the accompanying drawings.

IN THE DRAWINGS

DETAILED DESCRIPTION

Figure 1:
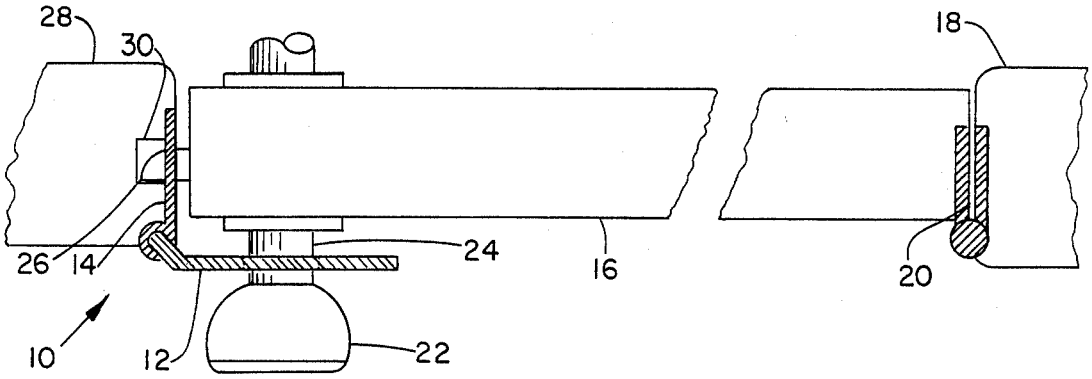
FIG. 1 is a top view depicting the present invention, with a conventional door and doorjamb shown in the phantom lines.

The present invention has been briefly described as a door locking or fastening method and apparatus for prohibiting the opening of a conventional hinged door by an intruder. The present invention enables the door to be locked from the inside, and is designed for protecting both property and persons. Since the method and apparatus of this invention is only suitable for locking the door from the inside of an apartment, office, or room, it will be readily understood that a primary feature of the invention is the protection of persons since the device would generally be utilized when the individual is within the living or working quarters.

It may also be understood that the present invention is compatible with conventional door locks, and is intended to supplement rather than replace conventional door locks. Thus, the invention may be fully utilized with both a conventional doorknob lock and a deadbolt lock, although neither of such locks clearly need be employed to obtain the features and advantages of this invention. Such conventional knob locks and deadbolt locks are widely known and fully described in the prior art, and will not be discussed in detail. Such conventional locks and deadbolt locks are briefly described, for example, in U.S. Pat. No. 3,809,418, which is hereby incorporated by reference.

As indicated, it is a feature of this invention that methods and apparatus may be employed for preventing the opening of the door which are both simplistic and inexpensive, yet highly efficient. Moreover, the device of the present invention may be easily installed with a screwdriver and does not marr, deface, or otherwise damage the door or the doorjamb.

The benefits of a simplistic yet highly efficient door locking device may be readily appreciated. With respect to the ease of installation and non-marring of the door, it should be appreciated that the invention is particularly suitable for individuals, both young and old, who either live alone or spend a good deal of time alone during the day or night. Many people are reluctant to purchase a door-locking device which must be professionally installed, not only because of the installation expense, but because the individual's desire not to let unknown installers know that they fear for their security. Also, many individuals lease or rent their living or working quarters, such as apartments or small offices, and the landlord's regulations either do not permit the installation of devices which might marr or deface the door or the doorjamb, or require that the tenant pay all costs associated with refinishing the door or doorjamb to its original condition. Because of desired mobility, therefore, these individuals often do not utilize door securing devices, other than possibly conventional deadbolt locks, which are not provided by the landlord.

It should also be understood that many individuals do not utilize effective door locking devices, in part, because these individuals do not wish to admit to friends, salesmen, or other callers that they desire this degree of protection. Such people may easily learn of extraordinary door locking devices both when the device is being utilized (since friends and visitors may notice the device when in place), and when the device is temporarily removed to allow access to an individual. Thus, many people believe that if an individual notices extraordinary security devices once being admitted to an office or apartment, these individuals might think that this person is either not well protected when the device is not in place and once the individual is admitted, or may believe the individual must have valuable property deserving such protection.

Figure 2:
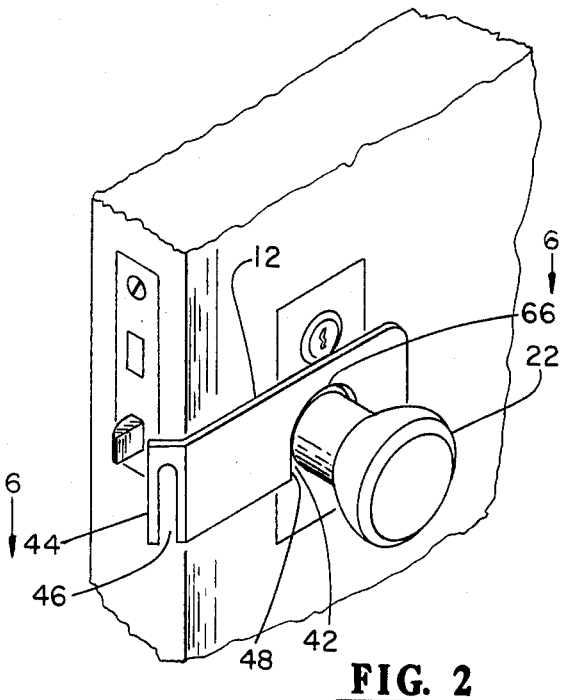
FIG. 2 is a front pictorial view of the main plate according to the present invention, with a portion of a conventional door shown in phantom lines.
Figure 3:
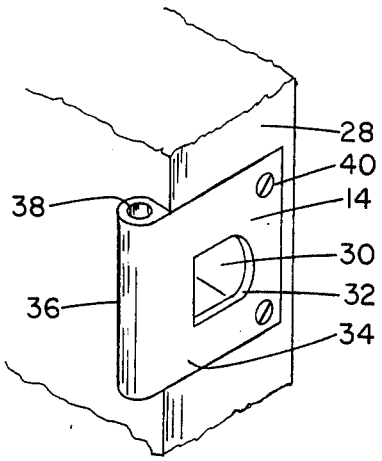
FIG. 3 is a front pictorial view of the modified strike plate according to the present invention as installed against a conventional doorjamb.

One may readily understand from FIGS. 1, 2 and 3 that the present invention will not in any manner marr or otherwise deface the door or the doorjamb, that the device may be easily installed by simply removing the existing strike plate with a screwdriver and replacing the modified strike plate according to the present invention, and that the device is relatively inexpensive. Also, it will be more fully understood from the following that the device may be easily and simply utilized and that the device offers an extremely high degree of security against unauthorized intruders. Moreover, the device does not detract from the overall aesthetic appearance of the door, either when the device is in use or when the main plate is temporarily removed.

Referring now to FIG. 1, there is depicted a door locking device 10 of the present invention comprising a main plate 12 and a modified strike plate 14. The device may be utilized in conjunction with a conventional door 16, which pivots about doorjamb 18 at the location of conventional door hinges 20. The door 16 also contains a conventional spherical-shaped interior doorknob 22, a conventional door handle neck portion 24, and a conventional bolt 26 or other latch means movable toward the jamb 18 for opening the door. FIG. 1 also depicts a conventional doorjamb 28 containing a rectangular-shaped opening 30 for receiving the bolt 26. As shown in FIG. 1, the conventional strike plate which normally is positioned over the aperture 30 has been removed, and a new strike plate 14 of the present invention has been installed.

Referring now to FIG. 3, it may be seen that the strike plate 14 of the present invention is generally positioned over the aperture 30 and contains a corresponding aperture 32 approximating the size of the opening 30. The strike plate comprises a flat plate portion 34 and a cylindrical strike plate securing portion 36 which may be welded to the portion 34. The cylindrical portion 36 contains a cylindrical bore or aperture 38, so that the axis of the bore 38 will be generally vertical when the plate 14 is installed on the doorjamb 28. Plate 14 may be installed by many conventional means, such as bolts or wood screws 40, which are preferably extra long and hardened to be secured to an interior stud in the doorjamb 28, so that the strike plate 14 cannot be pried or otherwise removed from the doorjamb 28 by an intruder.

Referring now to both FIGS. 2 and 3, it may be understood that once the strike plate 14 has been installed, the main plate 12 may be vertically lowered so that the cut out portion 42 slips over the neck portion 24 of the door handle, while simultaneously the pin member 44 is fitted into the bore 38 of the cylindrical portion 36 of the strike plate 14. The pin portion 44 may be secured to the main plate 12, or may be easily formed as part of the main plate by cutting a slot 46 in the main plate, as depicted in FIG. 2.

When the securing device of the present invention is not in use, it may be understood that the main plate 12 may be removed and stored in a convenient place. When the securing device is thus not in use, the only portion of the device which might be viewed as being unusual would be the cylindrical portion 36 of the strike plate 14. Moreover, as seen in FIG. 1, it will readily be appreciated that one would likely not detect the presence of the cylindrical portion 36 when the securing device is not being utilized.

When the securing device is operational, the main plate 12 will have been positioned over the doorknob 22, as shown in FIGS. 1 and 2, so that the pin 44 is fitted in the aperture or bore 38. Even with the plate 12 in place, however, it will be readily appreciated that the device according to the present invention does not materially affect the aesthetic quality or appearance of the door, since the device is both extremely compact and simplistic. With respect to the appearance of the device, it should be further understood that the main plate 12 may be easily fabricated from quality flat-plate metal, which may be brushed, treated, or otherwise plated to conform to the finish of the doorknob.

It should be understood that when the main plate is removed, the strike plate 14 does not restrict the opening of the door. With the main plate in place so that the pin 44 is fitted within the bore 38, the door is locked or prohibited from opening due to at least one of the following reasons. Referring to the FIGS. 1 and 2, it may be seen that the edge surface 48 forming the slot 42 in the main plate is structurally arranged to either be in engagement with the external diameter of the neck 24, or would quickly engage the external diameter of the neck 24 if the door were to be slightly open. Since the pin 44 may rotate slightly in the bore 38, but the pin is also in a fixed position relative to the edge 48, the door is prevented from opening. Referring now to FIG. 1, a second type of action may also prohibit the opening of the door. Even if the edge 48 is not in engagement with the neck 24, it may be realized that as the door would slightly open, the door 16 may engage the main plate 12, but as soon as the main plate 12 would commence rotating about the pin 44 due to the force applied to the door 16, the body of the main plate 12 would also engage the doorknob 22 so that a binding-type action would prohibit further rotation of the main plate 12 and therefore prohibit further opening of the door. Thus, at least one or a combination of the above actions may reliably prohibit opening of the door.

Figure 4:
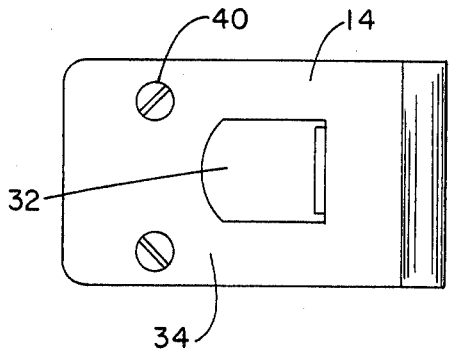
FIG. 4 is a front view of the strike plate according to the present invention.
Figure 5:
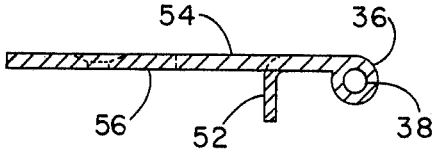
FIG. 5 is a side view of the strike plate shown in FIG. 4.

Referring now to FIGS. 4 and 5, certain features of the strike plate 14 will be discussed in detail. Since the plate body 34 may be easily stamped from sheet metal or metal plate, at least a portion of the metal removed to form the aperture 32 may be simply deformed 90° to form the tab 52, as shown in FIG. 5. This tab 52 gives added strength to the strike plate and can be fitted within the aperture 30 when the strike plate is mounted to the doorjamb 28. The cylindrical portion 36 may also be formed from sheet metal or metal plate, and bent to the desired shape and then welded to the portion 34, or may be formed as a separate piece and then welded or otherwise affixed to the portion 34.

As seen in FIGS. 1 and 5, the outer diameter of the cylindrical portion 36 is preferably approximately along a line parallel with the outer face 54 of the portion 34, so that the door will easily open when the main plate 12 is removed. It should be understood that the axis of the cylindrical portion 36 may be aligned approximately with the inner face 56, the outer face 54, or the center line of portion 34, as long as the door may open when the main plate 12 is removed. In order to minimize the visibility of the strike plate, both when the main plate is in place and when the main plate is removed, it is a feature of the present invention that the cylindrical portion 36 be rigidly attached to the portion 34 in the location approximately adjacent the internal corner of the doorjamb 28.

Figure 6:
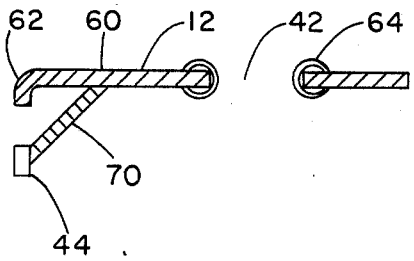
FIG. 6 is a cross-sectional view of the main plate depicted in FIG. 2.
Figure 7:
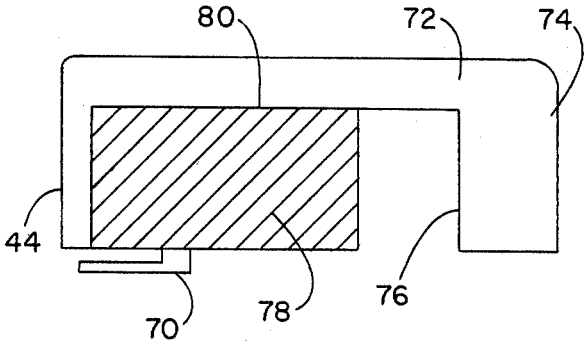
FIG. 7 is a front view of an alternate embodiment of the main plate shown in FIG. 2.

Referring now to FIGS. 6 and 7, additional features and modifications of the main plate 12 will be discussed. It should be understood that the pin 44 is fixidly secured to the main body plate portion 60, and is structurally arranged for fitting engagement within the bore 38. Since the cylindrical portion 36 may be adjacent the outer corner of the doorjamb 28, a 90° bend 62 to the main plate may be necessary, as shown in FIGS. 1 and 6. The slot 42 is preferably only slightly larger in width than the neck 24, and both side surfaces and the top surface of the slot 42 may be fitted with a rubber, plastic, moldable, or otherwise easily deformable C-shaped edge guard 64, so as to prevent scratching of the neck 24 while providing a tight fit between the edge 48 and the outer surface of the neck 24.

The upper surface 66 of the slot 42 is preferably convex-shaped, but may also be cut in a rectangular configuration, as shown in FIG. 7. Referring now to FIG. 1, it may be desirable to provide a simple clasp to prevent an intruder from slipping a thin tool between the doorjamb 28 and the door 16, and thus possibly forcing the main plate 12 upwards so that the pin 44 may come out of the bore 38. As shown in FIGS. 6 and 7, a simple clasp 70 may be rotatably mounted to the bottom surface of the portion 60 by conventional means, such as a screw. The clasp 70 may have its tip rotated away from the pin 44 so that the main plate could be installed, and once the main plate is in place, the clasp 70 may be rotated so that the tip of the clasp would be approximately under the pin 44, and thus under the cylindrical portion 36. The clasp 70 would thus function as a stop means so that the main plate 12 could not be raised without first rotating the clasp 70. In addition, conventional clasp-locking means, such as an axially movable rotatable clasp in conjunction with a spring (not shown) could be employed to insure that an intruder could not manage to first rotate the tip of the clasp 70 and then raise the main plate 12. As shown in FIG. 7, the main plate 12 comprises a top portion 72 which is fixedly secured to the pin 44, an outer body portion 74 extending below the top portion 72, and the edge 76 adjacent slot 42 for engagement with the neck 24. It is therefore, not essential that the front plate contain the lower inner portion 78 below the dashed line 80 in FIG. 7, although such a lower inner portion 78 may be desirable both for appearance and for additional strength.

Other variations clearly within the scope of this invention are not shown in the figures but will readily be understood from the following description. The pin 44 is basically an elongate member which is secured to the upper portion 72. Although the pin may be circular in cross-sectional configuration, it is also within the concept of the invention that the pin 44 have any other cross-sectional configuration, such as being rectangular. Moreover, it will be understood that there are certain possible advantages if the pin 44 were rectangular in cross-sectional configuration and if the aperture 38 were also rectangular with approximately the same cross-sectional configuration, since then the plate 12 would not so easily rotate with respect to the strike plate 14.

The material for the front plate and the strike plate may preferably be metallic, and may be hardened or otherwise treated to increase yield strength. Both the main plate and the strike plate may be fabricated from material having a thickness between 1/16 and ¼ of an inch, and preferably having a thickness approximately ⅛ to 3/16 of an inch. Other material could obviously be used for the front plate and the strike plate, as long as the selected material had the desired yield strength to prevent the opening of the door.

It is also within the concept of the present invention that the pin 44 of the main plate 12 be in line with the main body of the plate, so that the 90° bend 62 would not be necessary. This will depend primarily upon the relationship between the neck 24 and the interior corner of the doorjamb 28, so that the main plate and strike plate will be structurally arranged so that the pin 44 may be vertically positioned in the aperture 38 as the main plate is lowered over the neck 24.

Although the locking device of the present invention has been described in relationship to a conventional door opening inwardly into a room, it is also within the concept of the present invention that the apparatus could be used for a door which would open outwardly, although the door locking apparatus would obviously still be installed from the interior of the room or office to be protected. Also, the present invention may be easily used in conjunction with double entry doors, either with a fixed center stud or with no center stud. In the latter instance, the modified strike plate may be installed on the end of a temporarily fixed or otherwise secured door, so that the fixed or secured door functions as the doorjamb to prevent opening of the other door.

The safety lock method and apparatus of the present invention can therefore be used on doors having key operated locks as well as on doors which either have no locks or a simple privacy lock. Moreover, the door locking apparatus of the present invention can be easily removed for reuse and leaves no holes or other damaging marks on the door or the door frame. In fact, although the strike plate of the present invention has been described above as being permanently secured to the doorjamb, it may be easily understood that a traveler may continue to utilize the present invention in hotel or other temporary quarters, since the device may be easily installed with a screwdriver. Further, components of the door locking apparatus are simple to manufacture and can be compactly stored and transported.

It will be obvious to those skilled in the art that the apparatus of the present invention may be manufactured in mass quantities for both left hand doors and right hand doors. In general, the interior neck portion of most door handles have approximately the same diameter, so that the main plate may be fabricated with a slot 42 of a single width or of a few standard varying widths. Moreover, the relationship between the neck portion of the interior door handle and the standard strike plate is fairly uniform, so that with a few models manufactured for different sized doorknob assemblies, the present invention will be well suited for mass production.

It will also be apparent from the foregoing that many other variations and modifications may be made in the methods and apparatus described herein without substantially departing from the essential concept of the present invention. Accordingly, it should be clearly understood that the forms of the invention described herein and depicted in the accompanying drawings are exemplary only and are not intended as limitations in the scope of the present invention.

What is claimed is:

1. A door fastening device including a hinged door having an interior doorknob, an interior door handle neck portion, latch means, and a doorjamb having an opening for receiving said latch means, comprising:

a flat plate portion fixedly mounted on said doorjamb and having a flat plate aperture generally positioned over said doorjamb opening;

a strike plate securing portion fixedly secured to said flat plate portion independent of said hinged door and having an elongate bore arranged with a substantially vertical axis positioned generally adjacent an interior corner of said doorjamb;

a main plate portion positioned over said door handle neck portion and having a slot for receiving said door handle neck portion;

an edge portion of said main plate portion forming said slot being structurally arranged for engagement with said door handle neck portion;

said vertical axis of said elongate bore spaced toward said flat plate aperture with respect to a plane defined by said main plate portion; and an elongate pin member spaced from said plane defined by said main plate portion and fixedly secured to an upper portion of said main plate portion and structurally arranged for positioning within said elongate bore for limiting movement of said main plate portion toward said door handle neck portion.

2. A door fastening device as recited in claim 1, wherein said pin member has a generally rectangular cross-sectional configuration to minimize rotational movement of said main plate portion relative to said flat plate portion.

3. A door fastening device as recited in claim 1, further comprising:

a deformable edge protecting means positioned over a substantial portion of said edge of said slot.

4. A door fastening device as recited in claim 1, further comprising:

spacing between said elongate pin member and said edge portion of said main plate portion is fixed for preventing opening of said door.

5. A door fastening device as recited in claim 1, further comprising:

latch means rotatably mounted to said main plate portion for restricting upward movement of said main plate portion relative to said flat plate portion.

6. A door fastening device as recited in claim 1, wherein said main plate portion is at least slightly rotatable with respect to said strike plate securing portion and is structurally arranged for binding engagement with said interior doorknob for preventing opening of said hinged door.

7. A door fastening device as recited in claim 1, wherein said pin member is spaced from said plane defined by said main plate portion and connected to said main plate portion by a bend of the material forming said main plate portion.

8. A door fastening device as recited in claim 1, wherein said vertical axis of said elongate bore is positioned opposite said hinged door with respect to a second plane defined by said flat plate portion.

9. A door fastening device as recited in claim 1, further comprising:

said strike plate securing portion having a generally cylindrical configuration with said vertical axis substantially aligned with a face of said flat plate portion.

10. A method of prohibiting opening of a door having an interior doorknob, an interior door handle neck portion and latch means, said door structurally arranged for closing against a doorjamb having an opening for receiving said door latch means, said method further comprising:

affixing a strike plate securing portion having an elongate bore to said doorjamb independent of said door;

positioning said strike plate securing portion with said elongate bore arranged in a substantially vertical axis adjacent said interior corner of said doorjamb;

providing a main plate portion with an elongate pin member affixed thereto spaced from a plane defined by said main plate portion; and vertically lowering said main plate portion over said door handle neck portion and simultaneously positioning said elongate pin member fixedly secured to said main plate within said elongate bore and forming an interconnection between said main plate portion and said strike plate portion spaced from said plane defined by said main plate portion.

11. A method as defined in claim 10, further comprising:

providing stop means for restricting upward movement of said main plate relative to said strike plate.

12. A method as defined in claim 10, further comprising:

providing said main plate with a slot for receiving said door handle neck portion as said main plate is vertically lowered over said door handle neck portion.

13. A method as defined in claim 12, further comprising:

providing a deformable edge protector adjacent said slot for limiting damage to said door handle neck portion.

14. A method as defined in claim 12, further comprising:

structurally arranging said slot so that an edge of said main plate is in engagement with said door handle neck portion.

15. A door restraint mechanism for preventing the opening of a hinged door having an interior doorknob and an interior door handle neck portion, said hinged door positioned in a doorway having a doorjamb, said restraint mechanism comprising:

a flat plate portion for fixedly mounting on said doorjamb;

a strike plate securing portion fixedly secured to said flat plate portion independent of said hinged door and positioned generally adjacent an interior corner of said doorjamb and having an elongate aperture arranged with a substantially vertical axis;

a main plate portion for positioning over said door handle neck portion and having a slot for receiving said door handle neck portion;

an edge portion of said main plate portion forming said slot being structurally arranged for engagement with said door handle neck portion;

said vertical axis of said elongate aperture spaced toward said doorjamb with respect to a plane defined by said main plate portion; and an elongate pin member spaced from said plane defined by said main plate portion and fixedly secured to an upper portion of said main plate portion and structurally arranged for positioning within said elongate aperture for limiting movement of said main plate portion toward said door handle neck portion.

16. A door restraint mechanism as recited in claim 15, further comprising:

said strike plate securing portion having a generally cylindrical configuration with said vertical axis substantially aligned with a face of said flat plate portion.

17. A door restraint mechanism as recited in claim 15, further comprising:

spacing between said elongate pin member and said edge portion of said main plate portion is fixed for preventing opening of said door.

18. A door restraint mechanism as recited in claim 15, further comprising:

stop means rotatably mounted to said main plate portion for restricting upward movement of said main plate portion relative to said flat plate portion.

19. A door restraint mechanism as recited in claim 15, wherein said pin member is spaced from said plane defined by said main plate portion by a bend of the material forming said main plate portion.

20. A door restraint mechanism as recited in claim 15, wherein said vertical axis of said elongate aperture is positioned opposite said hinged door with respect to a second plane defined by said flat plate portion.

* * * * *